US005106004A

United States Patent [19]

Nguyen

[11] Patent Number: 5,106,004

[45] Date of Patent: Apr. 21, 1992

[54] CLOTHING ACCESSORY

[76] Inventor: Tuan D. Nguyen, 4212 Camargo Dr. (Apt. E), Dayton, Ohio 45415

[21] Appl. No.: 682,959

[22] Filed: Apr. 10, 1991

[51] Int. Cl.[5] ..... A44B 11/00; A44C 5/00

[52] U.S. Cl. ..... 224/163; 63/21; 24/163 K; 224/152; 224/903

[58] Field of Search ..... 224/163, 152, 170, 180, 224/224, 903, 282, 278; 368/277, 278, 314; 63/21; 24/163 K; 220/306, 324, 326; D10/31, 32

[56] References Cited

U.S. PATENT DOCUMENTS

| | | | |
|---|---|---|---|
| 630,208 | 8/1899 | Fogarty | 224/903 |
| 744,933 | 11/1903 | Nicholson | 224/903 |
| 2,527,090 | 10/1950 | Bauman | 224/152 |
| 2,613,676 | 10/1952 | Stepkin | 224/278 |
| 3,115,288 | 12/1963 | Aszkenas | 224/180 |
| 3,272,410 | 9/1966 | Reisman | 224/163 |

FOREIGN PATENT DOCUMENTS

| | | | |
|---|---|---|---|
| 858350 | 11/1940 | France | 224/163 |
| 71828 | 2/1915 | Switzerland | 368/277 |
| 2020539 | 11/1979 | Switzerland | 24/163 K |
| 459211 | 3/1935 | United Kingdom | 368/277 |

*Primary Examiner*—Henry J. Recla

*Assistant Examiner*—Keith Kupferschmid

*Attorney, Agent, or Firm*—Joseph Patrick Burke

[57] ABSTRACT

A combination watch/waist belt capable of use with interchangeable faceplates, each containing a housing and watch, and having a watch releasable and removable from its housing (case) yet attached thereto wherein the watch housing is readily detachable from an adjacent pair of buckle members attached to front portions of the waist belt in a quickly releasable manner. The wearer removes the watch from its housing by depressing a retainer to observe the time when desired. The watch is connected to its housing by a retainer cord or chain, which is inserted into a rear space in the watch housing upon placement of the watch back into its housing. The watch is retained, viz., held in position, by a clip in the upper central portion of its housing and a locator member in a recess in the bottom central portion of the housing. The watch is mounted on the central portion of the belt at the front of the wearer's waist. A quick release device located adjacent both sides of the watch housing permits easy disengagement of a given watch and housing and replacement with another offering the fashion conscious wearer a variety of belt-/watch ensembles for fashion coordination. The present watch/waist belt can be worn by both sexes.

10 Claims, 2 Drawing Sheets

CLOTHING ACCESSORY

BRIEF DESCRIPTION OF THE INVENTION

The present invention is directed to a combination watch/waist belt capable of use with interchangeable faceplates, each containing a housing and watch, and having a watch releasable and removable from its housing (case) yet attached thereto and readily detachable from an adjacent pair of buckle members attached to front portions of the waist belt in a quickly releasable manner. The wearer removes the watch from its housing by depressing a retainer to observe the time when desired. The watch is connected to its housing by a retainer cord or chain, which is inserted into a rear space in the watch housing upon placement of the watch back into its housing. The watch is retained, viz., held in position, by a clip in the upper central portion of its housing and a locator means in a recess in the bottom central portion of the housing. The watch is mounted on the central portion of the belt at the front of the wearer's waist. The quick release means located adjacent both sides of the watch housing permit easy disengagement of a given replacement with another offering the fashion conscious wearer a variety of belt/watch ensembles for fashion coordination. The present watch/waist belt can be worn by both sexes.

BACKGROUND OF THE INVENTION AND PRIOR ART

There has long been desired a way of wearing one's watch which permits freedom of the use of both hands yet safeguards the watch from damage, as costly a possession as fine watches can be. Similarly it has been desired to enable color, design and style coordination of the watch with the wearer's wardrobe, mood, and social or business setting in which the watch is to be worn.

It is also desirable to be able to vary the type or design of watch in accordance with the wearer's activity, e.g., athletic or sedentary, while permitting frequency of observation of time to be readily controlled by the wearer. These and other objectives have led to various efforts in the prior art to attempt to accomplish such objectives, which efforts have been met with varying success by a variety of structures.

U.S. Pat. No. 1,383,968 issued to C. Perry, Jr., et al is directed to a watch belt buckle wherein a watch (15) is mounted within buckle (3) having circular opening (13) of belt (1) in a reverse upside down fashion with the dials and indicia numbers facing inwardly and concealed by the curved watch backplate (FIG. 1) which forms the outwardly curved central surface of the buckle. The front face (14) of watch (15) is retained by a snap catch (16) struck out of the top edge (16') which engages stem (17) of watch (15). The watch case is preferably provided with a hook portion (18) integral therewith hinged in recess (19) of the front side (5) intermediate of the belt buckle to retain the front face (14) of the watch in its reverse position within opening (13) when the watch is in its normal (closed) position. When the stem (17) is released from the catch (16), the front face of the watch flips down approximately 180° (FIG. 2) permitting the wearer to observe the time either by tilting his/her head downwardly, or by rotating buckle (3) or watch (15) upwardly; or by a combination of both maneuvers.

In the modified form (FIG. 6), a hook (18*a*) is placed on the bottom of watch (15*a*), which is hinged to a vertical pintle (19*a*) to which a hinge member (2*a*) is secured. In this form watch (15*a*) lies entirely within the buckle, and belt (1*a*) passes through the buckle and in back of the watch. Then the wearer must turn the buckle away from his/her body to observe the time. Note that in this modification, the watch stem is mounted parallel to the long axis of the belt and no provision is made for flip down of the watch front face.

U.S. Pat. No. 1,382,256 issued to L. Tomchin is directed to a watch that is readily convertible into a wrist watch or pendant for wear either around the wrist or neck. There is no teaching in Tomchin of a waist watch. Tomchin is directed to an interchangeable pendant watch (FIG. 1) or a wrist watch (FIGS. 2 and 5) due to the provision of detachable coupling devices permitting attachment of the watch to flexible connections adapting it either for wrist or neck wear. A plurality of differently positioned peripheral coupling shoulders (c, c) on watch casing (C) via coupling members (A, A) or (A) enable the Tomchin watch to be used as a wrist or pendant watch, respectively. Watch (W) is shown mounted upside down as a pendant watch (FIG. 1) and wrist watch (FIGS. 2 and 5).

U.S. Pat. No. 2,182,194 issued to A. S. Blau is directed to a watch mounting which is a belt, or strap of a wrist watch (right col., 11, 7–9). The watch (12) having a side stem (14) has a case of any desired shape/configuration desirably shaped for special cooperation with mounting member plate (10). The Blau watch face is concealed and faces inwardly as worn. Watch (12) is mounted with its face surface in contact with the front face of plate (10) and secured to it by a hinge (16), one-half of which is fixed with the front face of (10) and the other half of which is fixed with the case of watch (12). Torsion spring means (18) cooperates with the two halves of hinge (16) to tension watch 12 normally urging it to swing toward one limit of its pivotable position. Catch means includes spring arm (20) secured to plate (10) opposite from hinge (16), and has struck tooth portion (22) cooperating with abutment (24) at the upper edge of the watch to hold it in its normal position. To observe time, the wearer presses the outer end of catch (20) outwardly away from watch (12) thus releasing tooth (20) from abutment (24). Watch (12) then swings downwardly and outwardly about its hinge axis to its dotted line position thus exposing the face of watch (12).

Ordinarily it will be desirable that hinge structure (16) be on the far side of the watch from the eye of the wearer when the watch is positioned to be read so that in opening up its face will be brought into substantially perpendicular relationship with respect to the wearer's line of vision (page 3, left col., 11. 18–24).

U.S. Pat. No. 1,278,866 issued to R. A. Thompson is directed to a belt-watch holder designed for clipping on a waist belt adjacent to its belt buckle. Watch (3) is contained in generally rectangular oblong holder (2) and secured to belt (1) and held in place via clasp member (10) and companion clasp member (11) of attaching strap (8). Outer strip (member) (4) of holder (2) is provided with a central annular flange or rim (12). Watch (3) can be mounted upside down as show in FIG. 1. There is no stated provision made for fashion coordination of watch face, with belt or wearer's clothing, eye color, etc. There is no contemplation of a readily removable connection of buckles.

U.S. Pat. No. 3,272,410 issued to E. Reisman is directed to a key belt which can have a watch (21) substituted for the wearer's house key (FIGS. 5 and 6). The watch casing is secured to a mounting plate (20) one end (20*a*) of which is bent or crimped about the outer portion of a loop member (11') and the other end of the mounting plate is bent in the form of a hook (20*b*) adapted to be passed through the other loop member (12') of the belt. The watch (21) serves a non-fastening function of the main belt buckle.

DETAILED DESCRIPTION OF THE INVENTION

Figures 1, 2, 3, 4, 5, 6:
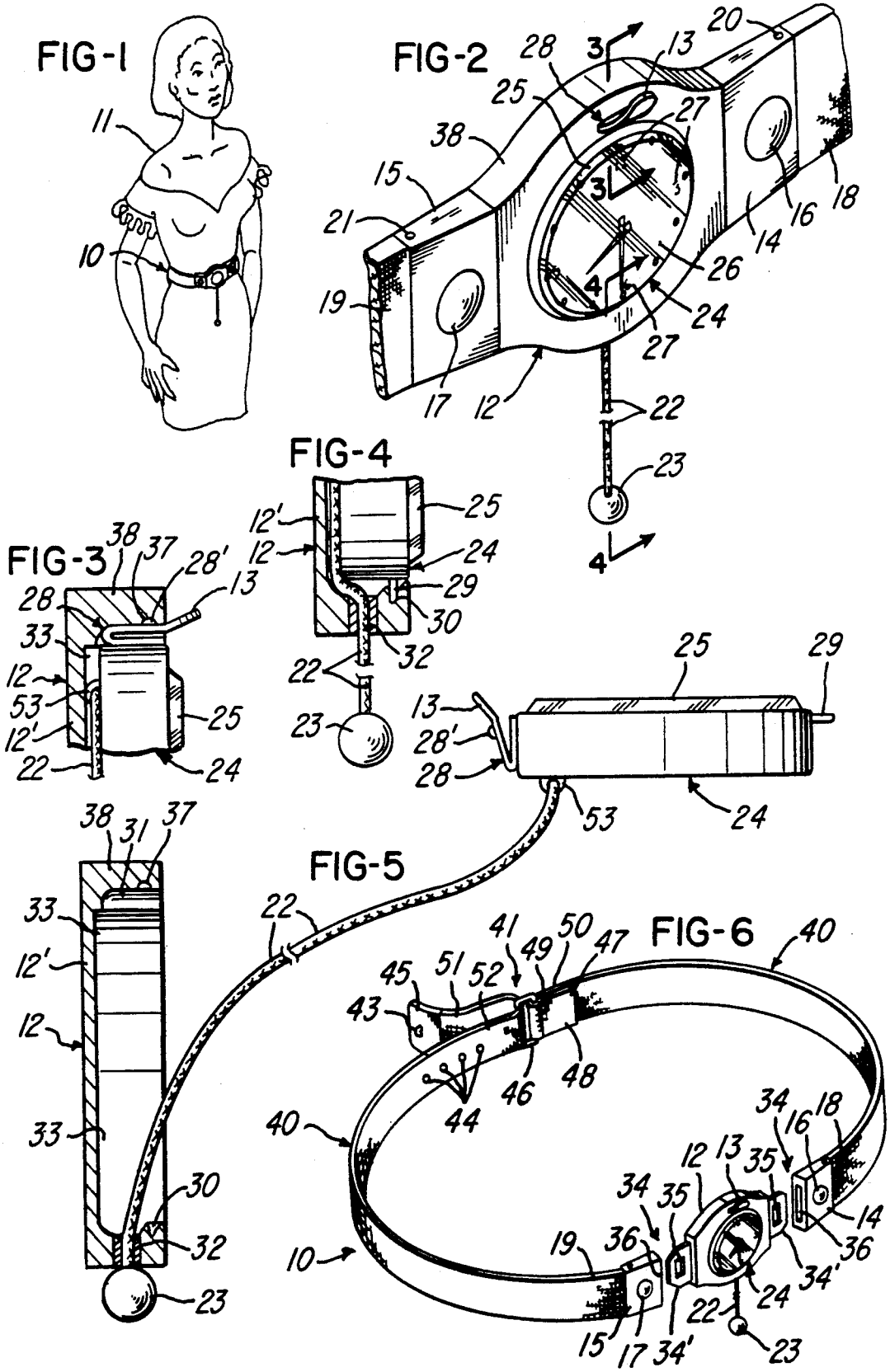
FIG. 1 is a perspective view of the environment in which the watch/waist belt of the present invention is worn.
FIG. 2 is a fragmentary perspective view of the watch/waist belt of the present invention with parts in section.
FIG. 3 is a cross sectional fragmentary view of the upper portion of the watch and watch housing illustrating how the clip means holds the upper portion in position.
FIG. 4 is a cross sectional fragmentary view showing the lower portion of the watch within its housing and illustrating how the locator means holds the lower portion in position.
FIG. 5 is a cross sectional view showing portions of the watch when it is removed by the wearer for observing the time.
FIG. 6 is a perspective view of the interchangeable watch housing 12 containing watch 24 separated from the belt buckles.
Figure 7:
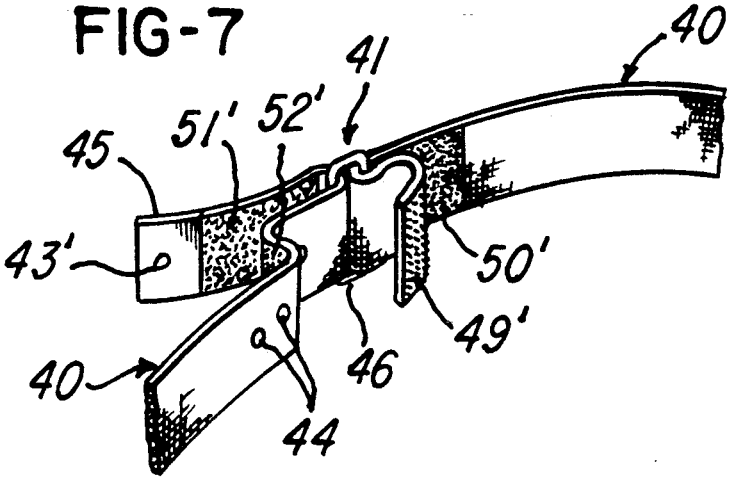
FIG. 7 is a perspective view of a portion of the rear of the watch waist belt.
Figure 8:
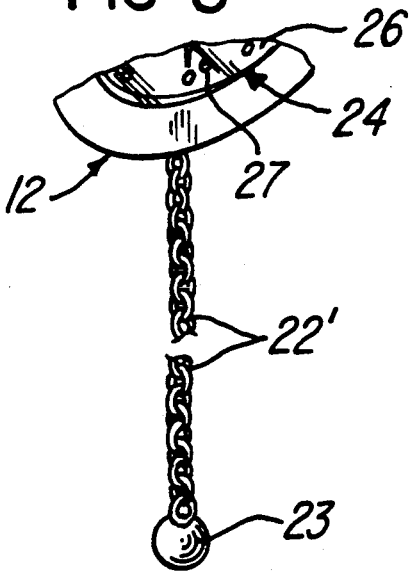
FIG. 8 is a partial view of the lower portion of the watch illustrating a chain.

As will be apparent from FIGS. 1 and 2, watch/waist belt 10 is worn around the waist of wearer 11 with its watch face 26 at the wearer's front in a manner such that a dial numbers 27 are in a right side up position, viz., with the dial numeral 12 at the top and the numeral 6 at the bottom while the removable watch 24 is positioned in its housing 12. Note especially FIG. 2 in this regard.

The watch housing (case) 12 can be easily detached from its adjacent pair of left and right hand buckle members 14 and 15, respectively, as illustrated in FIG. 6, by simply pressing on quick release left hand and right hand pressure release means, e.g. buttons, 16 and 17, respectively. This detaches (releases) fasteners 34, which can be substantially "D-shaped" male fasteners having attached ears 34' with openings 35, from their buckle members 14 and 15, which, e.g., can be female slotted buckle elements having slots 36 containing readily engageable and disengageable keeper catches (not shown) for interior engagement with fasteners 34 via their openings 35. Upon exerting downward pressure on release buttons 16 and 17, disengagement (release) of the housing and watch occurs. Conversely insertion of male ears 34' into slots 36 engages the interior catches with openings 35 causing retention of the fasteners, much like some automobile and airplane seat belts.

When the wearer desires to view the time of day, he/she simply presses downward on retainer portion 13 of compression spring clip 28 compressing it downwardly. This releases nipple 28' on the spring clip 28 freeing it from its recess 37, located in the lower central portion of top wall portion 38 of housing 12, FIGS. 3 and 5. This permits removal of watch 24 so the wearer may grasp same by lifting up to unseat locator means, e.g., pin 29 from its recess 30 and observe the time. Then the wearer tucks the appropriate potion of cord 22 or chain 22' into the rear accommodating space 33, pulls down on watch retainer and repositioning actuator 23 and inserts watch 24 having crystal 25 into housing 12 while placing locator pin 29 in its recess 30 and clip 28 in its recess 31. Cord (chain) attachment means 53 (FIG. 5) attaches watch 24 to cord 22 or chain 22'. Pulling down on retainer/actuator 23 allows chain 22' or cord 22 to move downwardly in bushing 32. Although FIG. 5 shows attachment means 53 positioned on the upper end of the back of watch 24, it can be located toward the middle or bottom portions thereof resulting in less required space 33 to accommodate cord (chain) 22.

As shown in FIG. 2, left hand and right hand belt pins 20 and 21, respectively, can be used to retain those left and right hand front facing portions 18 and 19, respectively of belt 40 in position with respect to buckles 14 and 15, respectively. At the rear of the belt 40 around the wearer's waist, e.g., a two piece belt, belt size adjustment means 41 (FIG. 6) includes any suitable means, e.g., curved or elbow shaped position setting hook 43 or pin 43' adapted for insertion into any one of position determining openings 44. Hook 43 or pin 43' can be located conveniently on the belt right rear distal end 45 which is passed through closed loop 46, attached to belt left rear distal end 47, prior to insertion into one of openings 44.

The attachment of that portion 48 of belt distal end 47 which is looped through the left hand facing portion of closed loop 46 can be reinforced in a readily releasable manner. This can be accomplished by providing its interior facing portion with a Velcro-type mating hook 49' or pile 50' fiber layer or structure to permit it to mate with a corresponding pile or hook layer or structure on the adjacent portion 50 of belt 40 adjacent its distal end 47 but which does not pass through loop 46. Similarly that portion of belt 40 adjacent to its distal end 45 can be a Velcro-type hook 52' or pile 51' layer or material to mate with the interior facing portion of belt 40, which contains openings 44, thus readily releasably reinforcing any selected positioning of hook 43 or pin 43' in any opening 44.

Thus there has been provided a watch waist belt comprising a watch housing; a watch readily releasable and removable from said housing and attached such that said watch is positioned with its dial numerals having number twelve above numeral six and visible; a cord or chain connecting the watch to its watch housing; an opening in a bottom central portion of the housing accommodating the cord or chain; a watch retainer and positioning actuator attached to a bottom end of the cord or chain having a dimension, e.g., diameter exceeding that of the cord or chain accommodating opening; a locator member attached to a front bottom central portion of said watch; a locator recess in a front central portion of said housing in which said locator member sits; a compression spring clip having a distal retainer portion fixedly secured to an upper portion of the watch; a recess located within an upper central portion of the housing accommodating the spring clip and having a detent within the recess; a nipple on an upper central portion of the spring clip positioned within the detent, the spring clip with nipple and detent serving to position and locate an upper portion of the watch within the housing; and a waist belt worn around a wearer's waist, and having a front portion releasably attached to the watch housing and a rear portion including belt sizing adjustment means.

I claim:

1. A watch waist belt comprising a watch housing; a watch readily releasable and removable from said housing and attached thereto such that said watch is positioned with its dial numerals having numeral twelve above numeral six and visible; a cord or chain connecting said watch to said watch housing; an opening in a bottom central portion of said housing accommodating said cord or chain; a watch retainer and positioning actuator attached to a bottom end of said cord or chain having a dimension exceeding a dimension of said cord or chain accommodating opening; a locator member attached to a front bottom central portion of said watch, a locator recess in a front central portion of said housing in which said locator member sits; a compression spring clip having a distal retainer portion fixedly secured to an upper portion of said watch; a recess located within an upper central portion of said housing accommodating said spring clip and having a detent within said recess; a nipple on an upper central portion of said spring clip positioned within said detent, said spring clip with nipple and said detent serving to position and locate an upper portion of said watch within said housing; and a waist belt worn around a wearer's waist, and having a front portion releasably attached to said watch housing and a rear portion including belt sizing adjustment means.

2. A watch waist belt as in claim 1 wherein said watch housing is readily releasably attached to the front portion of said belt by attachment to a pair of buckle members adjacent to said watch housing and wherein said buckle members are, in turn, each releasably attached to the front portion of said belt.

3. A watch waist belt as in claim 2 wherein each buckle member includes quick release means operable by pressure to cause detachment of said watch housing from said buckle members.

4. A watch waist belt as in claim 2 wherein said belt is a two piece belt and each buckle member is attached to a corresponding front portion of said belt by a pin.

5. A watch waist belt as in claim 1 wherein said rear portion includes a first and second rear end portion and said belt sizing adjustment means include a position setting hook or pin on the first rear end portion engageable within one of a plurality of position determining opengings located on the second rear end portion.

6. A watch waist belt as in claim 5 wherein said belt sizing adjustment means includes readily releasable mating Velcro-type hook and pile members for reinforcement.

7. A watch waist belt as in claim 1 wherein said belt is a two piece belt.

8. A watch waist belt as in claim 1 wherein pressure is downwardly applied on said clip retainer portion to release the nipple from the detent.

9. A watch waist belt as in claim 1 including a bushing between said cord or chain accommodating opening and a portion of said cord or chain.

10. A watch waist belt as in claim 1 wherein said watch retainer and positioning actuator's dimension is its diameter.

* * * * *